US008438872B2

(12) United States Patent
Yun et al.

(10) Patent No.: US 8,438,872 B2
(45) Date of Patent: May 14, 2013

(54) REFRIGERATOR RELATED TECHNOLOGY

(75) Inventors: Young-Hoon Yun, Seoul (KR); Bong-Jin Kim, Seoul (KR); Sang-Heon Lee, Seoul (KR); Seong-Jae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 720 days.

(21) Appl. No.: 12/731,745

(22) Filed: Mar. 25, 2010

(65) Prior Publication Data

US 2010/0257877 A1 Oct. 14, 2010

(30) Foreign Application Priority Data

Apr. 14, 2009 (KR) ..... 10-2009-0032502

(51) Int. Cl.
*F25D 3/02* (2006.01)

(52) U.S. Cl.
USPC ..... 62/425; 62/420; 62/441

(58) Field of Classification Search ..... 62/89, 137, 62/340, 425, 441, 449, 515
See application file for complete search history.

(56) References Cited

U.S. PATENT DOCUMENTS

| | | | |
|---|---|---|---|
| 6,945,068 | B2 | 9/2005 | Kim et al. |
| 7,076,967 | B2 | 7/2006 | Lee et al. |
| 7,188,479 | B2 * | 3/2007 | Anselmino et al. ..... 62/66 |
| 7,222,498 | B2 | 5/2007 | Lee et al. |
| 7,240,510 | B2 | 7/2007 | Lee et al. |
| 7,240,511 | B2 | 7/2007 | Lee et al. |
| 7,272,949 | B2 | 9/2007 | Lee et al. |
| 7,392,665 | B2 | 7/2008 | Lee et al. |
| 7,458,230 | B2 | 12/2008 | Lee et al. |
| 7,493,777 | B2 | 2/2009 | Kim et al. |
| 2005/0160756 | A1 | 7/2005 | Lee et al. |
| 2006/0096310 | A1 | 5/2006 | Lee |
| 2006/0196214 | A1 | 9/2006 | Lee et al. |
| 2008/0209938 | A1 | 9/2008 | Lee et al. |

FOREIGN PATENT DOCUMENTS

| | | |
|---|---|---|
| KR | 2005094671 A | 9/2005 |
| KR | 2006041437 A | 5/2006 |

OTHER PUBLICATIONS

International Search Report & Written Opinion issued in Application No. PCT/KR2010/001012, mailed Aug. 31, 2010, 10 pages.

* cited by examiner

*Primary Examiner* — Melvin Jones
(74) *Attorney, Agent, or Firm* — Fish & Richardson P.C.

(57) ABSTRACT

A refrigerator and its operation method are disclosed. Cool air ducts guide cool air from a freezing compartment to an ice compartment that is positioned at a refrigerating compartment door. At least a portion of the cool air ducts are located at a barrier that separates the freezing compartment and the refrigerating compartment.

26 Claims, 14 Drawing Sheets

REFRIGERATOR RELATED TECHNOLOGY

CROSS REFERENCE TO RELATED APPLICATIONS

The present application claims priority to Korean Application No. 10-2009-0032502 filed in Korea on Apr. 14, 2009, the entire contents of which is hereby incorporated by reference in its entirety.

FIELD

The present disclosure relates to refrigerator technology.

BACKGROUND

In general, a refrigerator is a device for maintaining food items at a low temperature in a certain accommodating space, including a refrigerating chamber maintained at temperature of above zero and a freezing chamber maintained at temperature of below zero. Refrigerators may include an automatic ice making device.

The automatic ice making device may be installed in the freezing chamber or in the refrigerating chamber. When an ice making chamber including the ice making device is installed in the refrigerating chamber, a cool air duct may be provided to guide cool air to the ice making chamber from the freezing chamber.

For example, a 3-door bottom freezer type refrigerator has a freezing chamber disposed at a lower portion and a refrigerating chamber disposed at an upper portion. An evaporator is installed on a rear wall face and an ice making chamber is installed at an upper portion of a refrigerating chamber door. A cool air duct for guiding cool air of the freezing chamber to the ice making chamber is provided.

SUMMARY

In one aspect, a refrigerator includes a refrigerator body, a refrigerating compartment defined at a first portion of the refrigerator body, and a freezing compartment defined at a second portion of the refrigerator body. The second portion of the refrigerator body is different than the first portion of the refrigerator body and the freezing compartment is separated from the refrigerating compartment by one or more walls. The refrigerator also includes at least one evaporator configured to cool air used in regulating operating temperatures in the refrigerating compartment and the freezing compartment that differ, with the freezing compartment having an operating temperature that is lower than an operating temperature of the refrigerating compartment. The refrigerator further includes a refrigerating compartment door that is configured to open and close at least a portion of the refrigerating compartment, a freezing compartment door that is configured to open and close at least a portion of the freezing compartment, and an ice compartment positioned at the refrigerating compartment door and configured to receive cool air from the freezing compartment. In addition, the refrigerator includes one or more ducts defining a first flow path configured to circulate cool air between the freezing compartment and the ice compartment and one or more ducts defining a second flow path configured to circulate cool air between the freezing compartment, the ice compartment, and the refrigerating compartment. Further, the refrigerator includes an ice level sensor configured to detect a level of ice within the ice compartment and a unit positioned at the second flow path and configured to control air flow along at least a portion of the second flow path based on the level of ice within the ice compartment.

Implementations may include one or more of the following features. For example, the refrigerator may include an ice maker positioned within the ice compartment and configured to freeze liquid water into ice. In this example, the ice level sensor may include a full ice sensor configured to detect whether or not ice making has been completed by the ice maker and the unit is configured to control air flow along at least a portion of the second flow path based on the detection of whether or not the ice making in the ice compartment has been completed.

In addition, the refrigerator may include a temperature sensor configured to detect temperature of the refrigerating compartment and the unit may be configured to control air flow along at least a portion of the second flow path based on the temperature of the refrigerating compartment detected by the temperature sensor. The one or more ducts defining the first flow path may include a supply duct positioned on an interior surface of the refrigerating compartment door at a first side of the refrigerating compartment door, the supply duct defining a supply flow path, and a return duct positioned on the interior surface of the refrigerating compartment door at a second side of the refrigerating compartment door that is opposite of the first side, the return duct defining a return flow path. A second unit mat be positioned at a barrier that separates the freezing compartment and the refrigerating compartment. The second unit may define, through the barrier, a supply passage configured to interface with the supply duct when the refrigerating compartment door is oriented in a closed position and separate from the supply duct when the refrigerating compartment door is oriented in an opened position. The second unit also may define, through the barrier, a return passage configured to interface with the return duct when the refrigerating compartment door is oriented in the closed position and separate from the return duct when the refrigerating compartment door is oriented in the opened position. The second unit further may include at least one blocking unit that is configured to open the supply passage and the return passage when the refrigerating compartment door is oriented in the closed position and close the supply passage and the return passage when the refrigerating compartment door is oriented in the opened position.

In another aspect, a refrigerator includes a refrigerator body, a refrigerating compartment defined at a first portion of the refrigerator body, and a freezing compartment defined at a second portion of the refrigerator body. The second portion of the refrigerator body is different than the first portion of the refrigerator body and the freezing compartment is separated from the refrigerating compartment by a barrier. The refrigerator also includes at least one evaporator configured to cool air used in regulating operating temperatures in the refrigerating compartment and the freezing compartment that differ, with the freezing compartment having an operating temperature that is lower than an operating temperature of the refrigerating compartment. The refrigerator further includes a refrigerating compartment door that is configured to open and close at least a portion of the refrigerating compartment, a freezing compartment door that is configured to open and close at least a portion of the freezing compartment, and an ice compartment positioned at the refrigerating compartment door and configured to receive cool air from the freezing compartment. In addition, the refrigerator includes one or more door ducts positioned at the refrigerating compartment door and configured to guide cool air from the freezing compartment to the ice compartment. Further, the refrigerator includes a refrigerating compartment supply duct configured to guide cool air from the freezing compartment to the refrigerating compartment and a refrigerating compartment return duct configured to guide cool air of the refrigerating compartment to the freezing compartment. The refrigerator includes a first unit that is positioned at the barrier that separates the freezing compartment and the refrigerating compartment. The first unit is configured to connect, through one or more passages in the barrier, the one or more door ducts to the freezing compartment when the refrigerating compartment door is oriented in a closed position. The first unit also is configured to close the one or more passages in the barrier when the refrigerating compartment door is oriented in an opened position. The refrigerator also includes a second unit positioned at the ice compartment and configured to open and close a passage defined in a wall that separates the ice compartment from the refrigerating compartment.

Implementations may include one or more of the following features. For example, the first unit may include a housing having one or more cool air through holes that allow the one or more door ducts and the freezing compartment to communicate when the refrigerating compartment door is oriented in the closed position and a plate configured to open and close the one or more cool air through holes of the housing in response to closing and opening of the refrigerating compartment door. In this example, the refrigerator may include an elastic member positioned at one side of the plate. When the refrigerating compartment door is oriented in the opened position, the elastic member may apply force to the plate in a direction that causes the plate to close the one or more cool air through holes.

In some examples, the refrigerator may include a guide hole defined by the housing and a guide unit that is coupled to the plate. The guide unit may have at least a portion inserted into the guide hole, may be configured to be pressed by the refrigerating compartment door when the refrigerating compartment door moves from the opened position to the closed position, and may be configured to, in response to being pressed by the refrigerating compartment door, move the plate from a first position in which the plate closes the one or more cool air through holes to a second position in which the plate opens the one or more cool air through holes. The refrigerator may include a sealing member provided to at least one of the one or more door ducts and the one or more cool air through holes. A portion of the housing where an end of the one or more door ducts interfaces with the one or more cool air through holes may be inclined relative to ground when the refrigerator body is oriented in an ordinary operating orientation. Further, a portion of the housing where an end of the one or more door ducts interface with the one or more cool air through holes may be perpendicular to ground when the refrigerator body is oriented in an ordinary operating orientation.

In some implementations, the refrigerator may include an ice maker positioned within the ice compartment and configured to freeze liquid water into ice and the second unit may be configured to open and close the passage defined in the wall that separates the ice compartment from the refrigerating compartment based on whether or not ice making by the ice maker has been completed and a temperature of the refrigerating compartment. In these implementations, the refrigerator may include a full ice sensor configured to detect completion of ice making by the ice maker and the second unit may be configured to open the passage in response to detection, by the full ice sensor, of completion of ice making by the ice maker. In these implementations, the refrigerator may include a temperature sensor positioned in the refrigerating compartment and the second unit may be configured to open the passage in response to detection, by the temperature sensor, of a temperature in the refrigerating compartment that is higher than a pre-set temperature level.

A cross-sectional area of an outlet of the second unit may be larger than a cross-sectional area of an outlet of the one or more door ducts. The one or more door ducts may include a first door duct configured to guide cool air of the freezing compartment to the ice compartment and a second door duct separated from a flow path of the first door duct and configured to guide cool air of the ice making compartment to the freezing compartment. The refrigerator may include an ice maker positioned within the ice compartment and configured to freeze liquid water into ice and an outlet of the first door duct and an inlet of the second door duct are positioned on opposite sides of the ice maker such that air flow from the outlet of the first door duct to the inlet of the second door duct passes over the ice maker. The one or more door ducts may be positioned such that at least a portion of the one or more door ducts is within a range of the refrigerator body when the refrigerating compartment door is oriented in the closed position.

Further, the refrigerating compartment door may include a protrusion on its inner surface such that the protrusion is positioned in the refrigerator body when the refrigerating compartment door is oriented in the closed position and the one or more door ducts are positioned on an inner face of the protrusion or at an inner side of the protrusion. The barrier may include a freezing compartment duct with a first end of the freezing compartment duct communicating with the freezing compartment and a second end of the freezing compartment duct communicating with at least one of the one or more door ducts when the refrigerating compartment door is oriented in the closed position. A blow fan may be positioned within at least one of the freezing compartment, the one or more door ducts, and the first unit and may be configured to promote movement of cool air of the freezing compartment to the ice making compartment. At least one evaporator may be configured to generate cool air and may be positioned on at least one of a wall face of the freezing compartment, a wall face of the refrigerating compartment, and within the barrier.

In yet another aspect, a method for controlling air flow in a refrigerator having a refrigerating compartment and a freezing compartment includes detecting, using an ice level sensor, a level of ice within an ice compartment that is positioned on a refrigerating compartment door configured to open and close at least a portion of the refrigerating compartment and that is configured to receive cool air from the freezing compartment. The method also includes controlling, using a unit positioned at a flow path that is defined by one or more ducts and that is configured to circulate cool air between the freezing compartment, the ice compartment, and the refrigerating compartment, air flow along at least a portion of the flow path based on the detected level of ice within the ice compartment.

Implementations may include one or more of the following features. For example, the method may includes detecting whether or not ice making in the ice compartment has been completed and controlling air flow along at least a portion of the flow path based on the detection of whether or not ice making in the ice compartment has been completed.

In addition, the method may include detecting, using a temperature sensor, a temperature of the refrigerating compartment and controlling air flow along at least a portion of the flow path based on the detected temperature of the refrigerating compartment. The method may include blocking air flow along at least the portion of the flow path when the detection of whether or not ice making in the ice compartment has been completed reveals that ice making in the ice compartment has been completed and when the detected temperature of the refrigerating compartment is less than a threshold temperature.

Further, the method may include detecting, using a temperature sensor, a temperature of the refrigerating compartment and controlling air flow along at least a portion of the flow path based on the detected temperature of the refrigerating compartment. The method may include allowing air flow along at least the portion of the flow path when the detected temperature of the refrigerating compartment is greater than a threshold temperature.

BRIEF DESCRIPTION OF THE DRAWINGS

FIGS. 17 and 18 are flow charts illustrating an example process of controlling a second damper according to whether or not an ice making chamber is full of ice; and FIG. 19 is a flow chart illustrating an example process of controlling a second damper according to a change in temperature of the refrigerating chamber.

DETAILED DESCRIPTION

Figure 1:
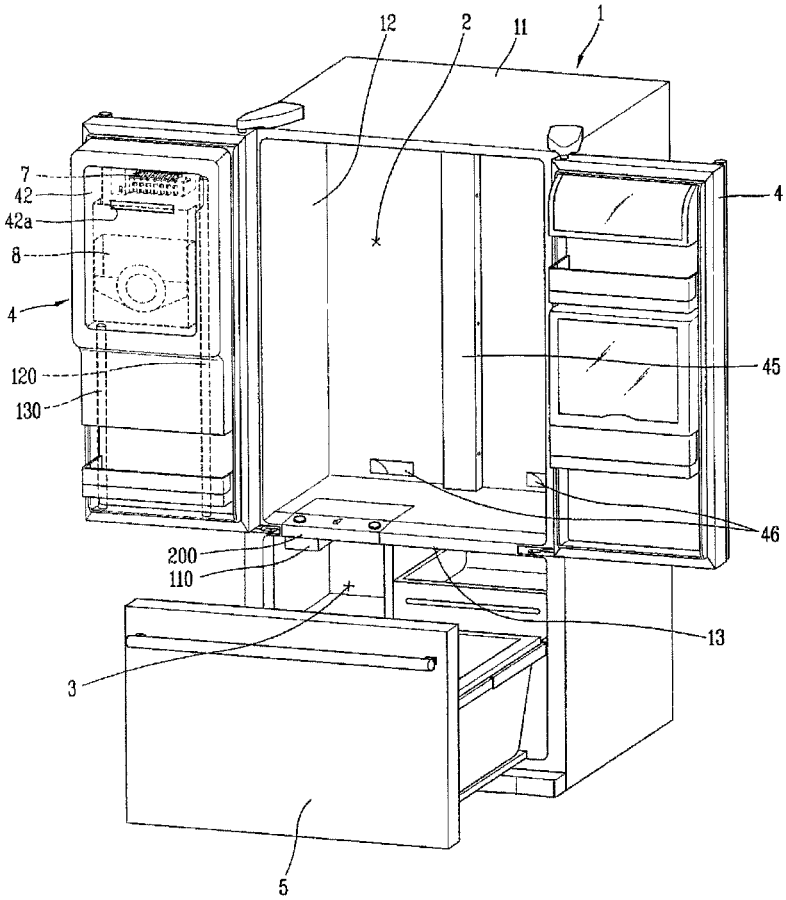
FIG. 1 is a perspective view of a 3-door bottom freezer type refrigerator.

FIG. 1 illustrates a 3-door bottom freezer type refrigerator. As shown in FIG. 1, a refrigerator includes a refrigerating chamber 2 defined at an upper portion of a refrigerator body 1. The refrigerating chamber 2 keeps food items in storage at a refrigerating temperature above freezing. A freezing chamber 3 is defined at a lower portion of the refrigerator body 1. The freezing chamber 3 keeps food items in storage at a freezing temperature at or below freezing.

The refrigerator body 1 includes an outer case 11 that defines an external appearance and an inner case 12 that is separately disposed at an inner side of the outer case 11 to define a food item accommodating space therein. A foaming agent or other insulation material is positioned between the outer case 11 and the inner case 12. The inner case 12 is divided into the refrigerating chamber 2 and the freezing chamber 3 with a horizontal barrier 13 interposed therebetween.

A plurality of refrigerating chamber doors 4 are installed at both sides of the refrigerating chamber 2 and open and close the refrigerating chamber 2 at both sides. A single freezing chamber door 5 is installed at the freezing chamber 3 to open and close the freezing chamber 3.

A machinery room in which a compressor and a condenser are installed is defined at a lower end of a rear surface of the refrigerator body 1, and an evaporator 6 (see FIG. 2) is installed at an inner side of the barrier 13 sectioning the refrigerating chamber 2 and the freezing chamber 3 and connected to the condenser and the compressor to supply cool air to the refrigerating chamber and/or the freezing chamber 3. A single evaporator 6 may be installed to supply cool air to the refrigerating chamber 2 and the freezing chamber 3, or a refrigerating chamber evaporator and a freezing chamber evaporator may be provided to independently supply cool air to the refrigerating chamber 2 and the freezing chamber 3, respectively.

An ice making chamber 41 is positioned at an inner wall face of an upper portion of one of the refrigerating chamber doors 4, and an ice making device 7 is installed at the inner side of the ice making chamber 41 to make ice. An ice storage container 8 is installed under the ice making device 7 to receive ice made by the ice making device 7. A dispenser (not shown) may be installed at a lower side of the ice making chamber 41 to allow ice stored in the ice storage container 8 to be dispensed out of the refrigerator such that it is dispensed to a front side of the refrigerating chamber door 4.

When a load in the refrigerating chamber 2 or in the freezing chamber 3 is detected, the compressor operates to generate cool air in the evaporator 6, and one portion of the cool air is supplied to the refrigerating chamber 2 and the freezing chamber 3 and another portion of the cool air is supplied to the ice making chamber 41. The cool air supplied to the ice making chamber 41 is heat-exchanged to allow the ice making device 7 mounted in the ice making chamber 41 to make ice. The cool air supplied to the ice making chamber 41 is returned to the freezing chamber 3 or supplied to the refrigerating chamber 2. The ice made by the ice making device 7 is stored in the ice storage container 8 and dispensed according to a request from the dispenser. This process is repeatedly performed.

When the evaporator 6 is installed in the freezing chamber 3 and when cool air generated from the evaporator is guided to the ice making chamber 41 disposed at the upper portion of the refrigerating chamber door 4, keeping a loss of the cool air to a minimum may be desired in order to reduce power consumption of the refrigerator. In some implementations, when cool air is transferred from the freezing chamber to the ice making chamber, a loss of cool air is reduced to thus reduce the power consumption of the refrigerator.

Figure 2:
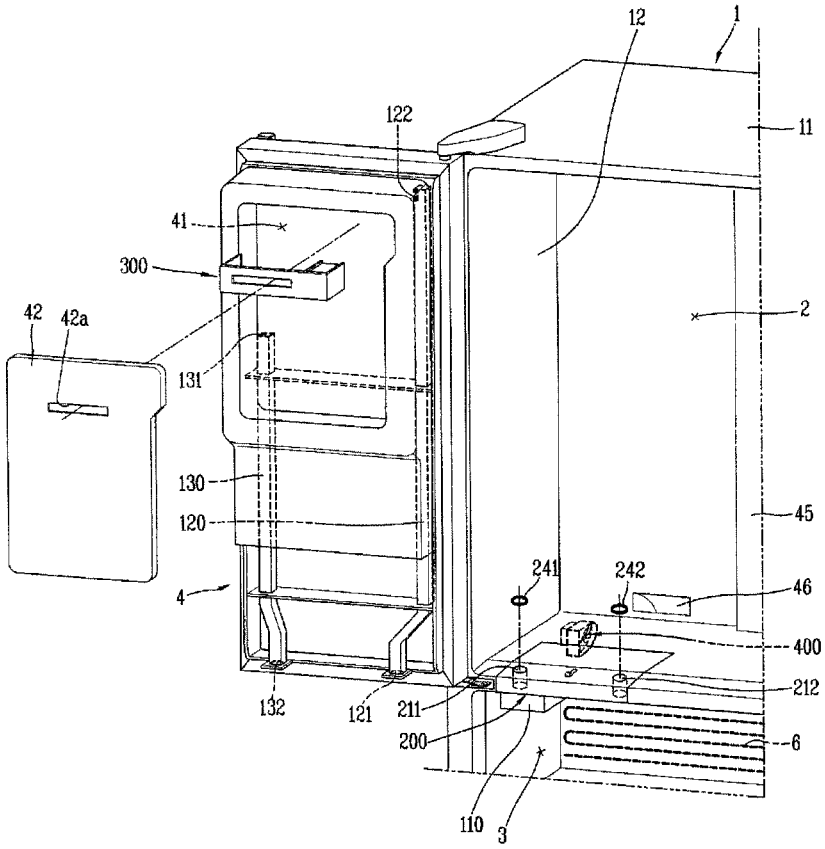
FIG. 2 is an enlarged perspective view of a cool air supply device of the refrigerator in FIG. 1.

FIG. 2 illustrates an example of the cool air supply device of the refrigerator. As shown in FIG. 2, the refrigerator is configured such that cool air of the freezing chamber is supplied to the ice making chamber via the refrigerating chamber door 4.

In this example, a freezing chamber duct 110 is installed on a lower surface of the barrier 13, namely, on the ceiling of the freezing chamber 3, to guide cool air from the freezing chamber 3 of the ice making chamber 41. A first door duct 120 is installed at one side of the refrigerating chamber door 4 and selectively connected with the freezing chamber duct 110 to supply cool air from the freezing chamber 3 to the ice making chamber 41. A second door duct 130 is installed at the other side of the refrigerating chamber door 4 to return cool air of the ice making chamber 41 to the freezing chamber 3. A damper 200 is installed at the barrier 13 to selectively connect the freezing chamber duct 110 and the first door duct 120 and selectively connect the freezing chamber 3 and the second door duct 130.

A cool air discharge hole 42*a* is defined at one side of the ice making chamber 41 (e.g., on an ice making chamber cover 42 that covers the ice making chamber 41) to supply cool air of the ice making chamber 41 to the refrigerating chamber 2. A refrigerating chamber return duct 46 is positioned on a rear wall face of the refrigerating chamber 2 to allow cool air supplied to the refrigerating chamber 2 to be returned to the freezing chamber 3 such that the refrigerating chamber 2 and the freezing chamber 3 are connected. A second damper 300 is installed at the cool air discharge hole 42*a* of the ice making chamber 41 to selectively supply cool air of the ice making chamber 41 to the refrigerating chamber 2. In some examples, the cool air discharge hole 42*a* of the ice making chamber 41 is defined such that its sectional area at least as large as that of the second door duct 130. In some implementations, its sectional area is larger than that of the second door duct 130, so that when the second damper 300 is open, cool air is introduced to the refrigerating chamber 2, not to the freezing chamber 3 according to the difference of flow path resistances.

A blower 400 is installed in the freezing chamber 3 to blow cool air generated from the evaporator 6 to the ice making chamber 41. An inlet of the freezing chamber duct 110 and an inlet of a multi-duct for directly supplying cool air of the freezing chamber 3 are installed to face each other at an outlet of the blower 400.

The ice making chamber duct 110 has a single hollow rectangular shape, and has an inlet defined at one end thereof and open toward the freezing chamber 3, specifically, toward the blower 400. The ice making chamber duct 110 has an outlet defined at another end thereof and open to be connected with a first cool air through hole 211 of a damper housing 210 (described in more detail below) toward the first door duct 120.

The freezing chamber duct 110 may be installed on the lower surface of the barrier 13, namely, on the upper inner wall face of the inner case at the side of the freezing chamber, and also may be buried within the barrier 13 based on the thickness of the barrier 13. The freezing chamber duct 110 may be separate from the damper 200 and installed by an attachment mechanism (e.g., screw), or may be integrally formed with the damper housing 210 accommodating each element of the damper 200. In other implementations, the damper housing 210 itself may be used as the freezing chamber duct 110.

Both the first and second door ducts 120 and 130 may have a hollow rectangular shape. The first door duct 120 is connected to the outlet of the freezing chamber duct 110 via the first cool air through hole 211 of the damper housing 210. The second door duct 130 is connected to another horizontal surface of the ice making chamber 41, namely, to a side different from the side to which the first door duct 120 is connected. The second door duct 130 is connected to the freezing chamber via a second cool air through hole 212 of the damper housing 210.

Figure 3:
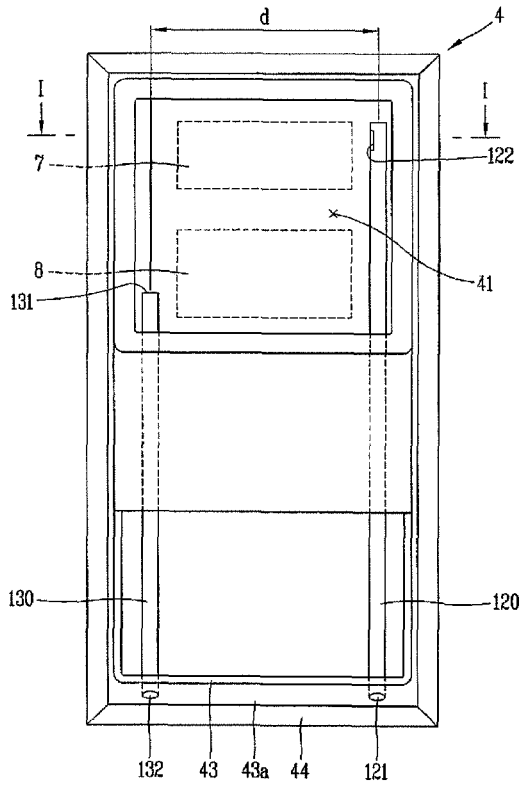
FIG. 3 is a plan view of a refrigerating chamber door of the refrigerator in FIG. 1.

The first and second door ducts 120 and 130 may be disposed to be as far away as possible from each other at both left and right sides in the widthwise direction of the refrigerating chamber door 4 as shown in FIG. 3 in order to increase an effective volume of the refrigerating chamber door 4 as well as to increase the distance (d) between an outlet 122 of the first door duct 120 and an inlet 131 of the second door duct 130 to allow cool air to circulate in the ice making chamber 41. In this case, the outlet 122 of the first door duct 120 may be oriented in a horizontal direction while the inlet 131 of the second door duct 130 may be oriented in a vertical direction to generate a flow resistance of cool air to thus lengthen time for cool air to stay in the ice making chamber 41. The outlet 122 of the first door duct 120 may be disposed to be higher than the inlet 131 of the second door duct 130 to supply cool air to the vicinity of the ice making device.

Figure 4:
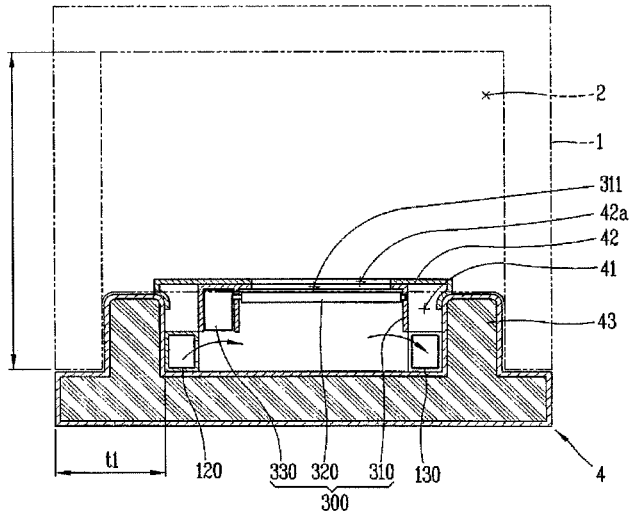
FIG. 4 is a sectional view taken along line I-I in FIG. 3, showing one example.

As shown in FIGS. 3 and 4, the first and second door ducts 120 and 130 may be have a rectangular shape, respectively, and may be assembled (e.g., mounted) to the inner surface of the refrigerating chamber door 4. In other implementations, the first and second door ducts 120 and 130 may be integrally formed when the inner case constituting the inner wall face of the refrigerating chamber door 4 is molded. Also, as shown in FIG. 4, the first and second door ducts 120 and 130 may protrude from the inner surface of the refrigerating chamber door 4, or may be recessed. When the first and second door ducts 120 and 130 protrude, the insulation thickness may be increased to reduce a heat loss to the exterior of the refrigerator. When the first and second door ducts 120 and 130 are recessed, the effective volume in the refrigerating chamber may be increased.

Figure 5:
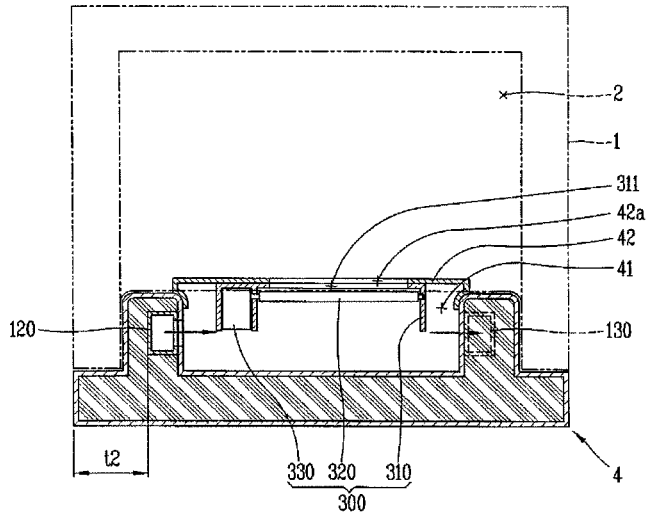
FIG. 5 is a sectional view taken along line I-I in FIG. 3, showing another example.

As shown in FIG. 4, the first and second door ducts 120 and 130 may be positioned at an inner side of the ice making chamber 41 of the refrigerating chamber door 4, or as shown in FIG. 5, the first and second door ducts 120 and 130 may be defined within protrusions 42 defining the ice making chamber 41 of the refrigerating chamber door 4. For example, when the first and second door ducts 120 and 130 are positioned within the ice making chamber 41 as shown in FIG. 4, the widthwise insulation thickness (t1) with respect to the first and second door ducts 120 and 130 may be increased. Meanwhile, when the first and second door ducts 120 and 130 are buried within the protrusions 43 as shown in FIG. 5, the widthwise insulation thickness (t2) with respect to the respective ducts 120 and 130 is reduced. However, when the first and second door ducts 120 and 130 are buried within the protrusions 43 as shown in FIG. 5, the thickness of the side wall of the refrigerator body 1 is maintained as it is, sufficiently preventing a loss of cool air that passes through the cool air ducts 120 and 130. Moreover, in the case where the first and second door ducts 120 and 130 are buried within the protrusions 43, the space of the ice making chamber 41 may be increased.

As shown in FIGS. 2 and 3, an inlet 121 of the first door duct and an outlet 132 of the second door duct may protrude from the lower surface of the refrigerating chamber door 4 (e.g., from an inner wall face of the lower end of the refrigerating chamber door 4) such that they open at the lower surface of the protrusions 43 inserted into the refrigerating chamber 2. In this example, if the refrigerating chamber door 4 slightly sags by its weight, the cool air passage may be more strongly sealed.

Figure 6:
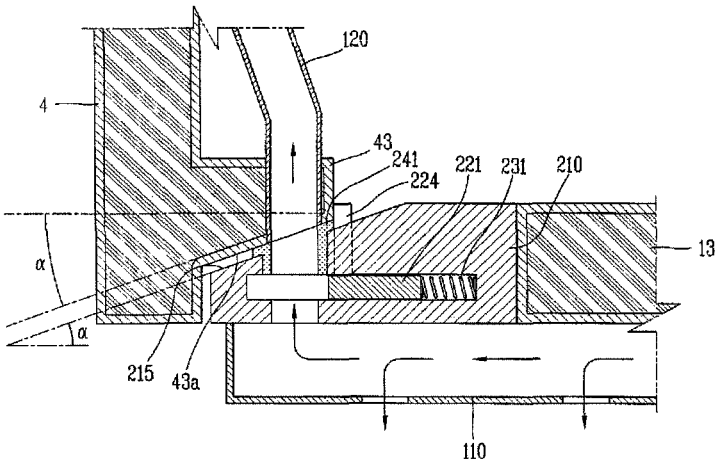
FIGS. 6 and 7 are vertical sectional views showing examples with respect to the direction of a cool air passage in the refrigerator of FIG. 1.

If the lower surface of the protrusion 43 of the refrigerating chamber door 4 is detachably attached to the upper surface of the barrier 13 in a tightly facing manner, as shown in FIG. 6, the lower surface of the protrusion 43 of the refrigerating chamber door 4 and a corresponding front upper surface (or the opening side) of the barrier 13 correspond to each other at a certain angle ($\alpha$). Namely, the lower surface of the protrusion 43 of the refrigerating chamber door 4 and the corresponding front upper surface may be slanted upwardly toward the rear wall face (or inner side) of the refrigerating chamber 2 in order to reduce contact abrasion of the cool air through holes 211 and 212 of the damping housing 210 and damper gaskets 241 and 242 installed at the second door duct 130.

Figure 7:
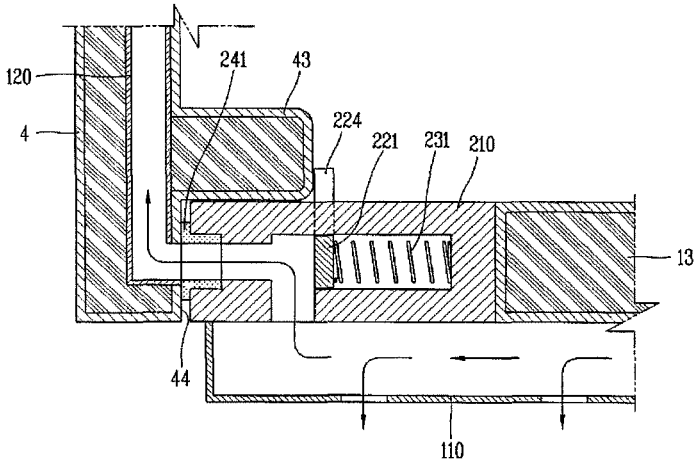

In other implementations, as shown in FIG. 7, the inlet 121 of the first door duct 120 and the outlet 132 of the second door duct 130 may be open to the inner wall face of the refrigerating chamber door 4, (e.g., open to a vertical sealing face 44 connected to the lower surface of the protrusion 43), and the corresponding outlet of the freezing chamber duct 110, (e.g., the cool air through holes 211 and 212 provided at the first damper housing 210) may be positioned at the front side of the first damper housing 210 at a same surface as the front side of the barrier 13. In these implementations, damage to the damper gaskets 241 and 242 may be reduced.

Figure 8:
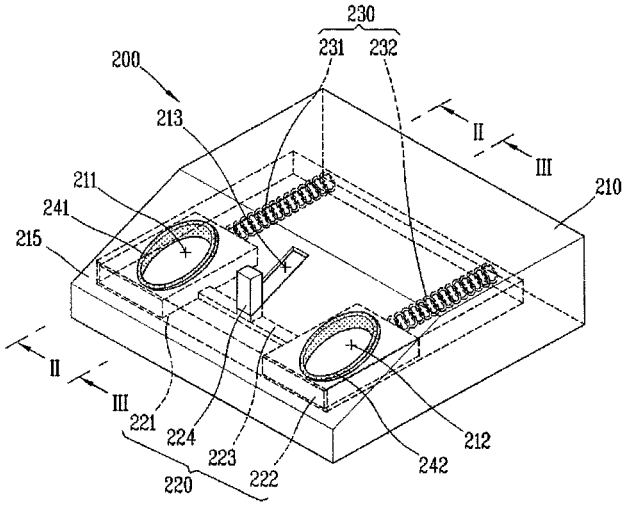
FIG. 8 is a perspective view of a first damper in the refrigerator of FIG. 1.

As shown in FIG. 8, the first damper 200 includes a first damper housing 210 including the plurality of cool air through holes 211 and 212 that connect the first damper 200 to the outlet of the freezing chamber duct 110. The first damper housing 210 may be coupled to the barrier 13. A first damper plate 220 is slidably coupled within the first damper housing 210 to open and close the cool air through holes 211 and 212 of the first damper housing 210, and damper springs 230 are installed at one side of the first damper plate 220 and elastically support the first damper plate 220 against the first damper housing 210. For instance, the first damper plate 220 and the damper springs 230 are installed within the first damper housing 210, forming a single module.

Figure 9:
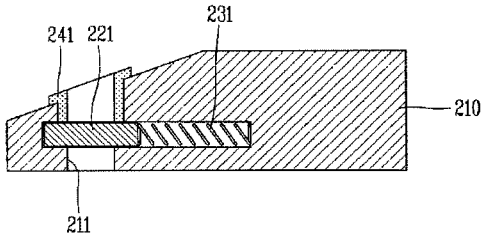
FIG. 9 is a sectional view taken along line II-II in FIG. 8.

As shown in FIGS. 8 and 9, the first damper housing 210 has a rectangular shape overall, and a front upper surface in contact with the lower surface of the protrusion 43 of the refrigerating chamber door 4 has a sealing face 215 at a certain slope angle ($\alpha$) increased toward the rear side. First and second cool air through holes 211 and 212 allow cool air to pass therethrough are positioned at the middle portion of the sealing face 215 of the first damper housing 210.

The first and second cool air through holes 211 and 212 are spaced apart in a widthwise direction. The first cool air through hole 211 connects with the inlet 121 of the first door duct 120 when the door is oriented in a closed position. The second cool air through hole 212 passes through the first damper housing 210 to allow the outlet 132 of the second door duct 130 and the freezing chamber 3 to communicate therethrough when the door is oriented in a closed position. A long guide hole 213 is defined in a forward/backward direction (e.g., in the direction that the refrigerating chamber door 4 is open and closed) between the first and second cool air through holes 211 and 212 to allow a guiding unit 224 to be slidably inserted therein.

The damper gaskets 241 and 242 may be installed on the upper surface of the first damper housing 210 (e.g., on the sealing face 215 corresponding to the inlet 121 of the first door duct and the outlet 132 of the second door duct 130 installed at the refrigerating chamber door 4, respectively) to reduce leakage of air that passes through the cool air through holes 211 and 212 of the damping housing 210. In this example, the damper gaskets 241 and 242 have the same ring shape as the cool air through holes 211 and 212 and are coupled to the cool air through holes 211 and 212. Although not shown, the damper gaskets 241 and 242 may be installed, respectively, on the lower surface of the refrigerating chamber door 4 (e.g., at the inlet 121 of the first door duct 120 and the outlet 132 of the second door duct 130) or may be installed at the cool air through holes 211 and 212 of the damping housing 210 and at the corresponding inlet 121 of the first door duct 120 and the outlet 132 of the second door duct 130.

As shown in FIG. 8, the first damper plate 220 includes a plurality of plate body parts. For instance, the first damper plate 220 includes first and second plate body parts 221 and 222 that have a width large enough to enable opening and closing of the first and second cool air through holes 211 and 212. The first and second plate body parts 221 and 222 are connected by a connection unit 223 that coordinates movement of the first and second plate body parts 221 and 222. A guide unit 224 is integrally formed in the middle of the connection unit 223 and positioned to contact the refrigerating chamber door 4 to open and close the first and second plate body parts 221 and 222 according to an opening and closing operation of the refrigerating chamber door 4. For example, when the refrigerating chamber door 4 closes, the refrigerating chamber door 4 contacts the guide unit 224 and presses the guide unit 224 along the guide hole 213. The pressing of the guide unit 224 causes the plate body parts 221 and 222 to depress the damper springs 231 and 232, respectively, and open the first and second cool air through holes 211 and 212. When the refrigerating chamber door 4 opens, the refrigerating chamber door 4 releases the guide unit 224 and the guide unit 224 moves back along the guide hole 213 based on the force of the damper springs 231 and 232 pressing the plate body parts 221 and 222, respectively. The plate body parts 221 and 222 close the first and second cool air through holes 211 and 212 based on the force of the damper springs 231 and 232.

In order to reduce leakage of cool air, the first damper plate 220 may have a surface that is shaped to slidably contact with the inner surface of the first damper housing 210. For example, if the first damper housing 210 has a uniform thickness, a front upper surface of the first damper plate 220 has the same slope angle ($\alpha$) as the sealing face 215 of the first damper housing 210, and if the inner surface of the first damper housing 210 is flat, the first damper plate 220 may be flat, as well.

In the above description, the plurality of the plate body parts 221 and 222 of the first damper plate are connected by the connection frame, but may not be. For instance, a single plate that is wide enough to open and close both the cool air through holes 211 and 212 may be used, or a single plate may be used such that a corresponding middle portion between the cool air through holes 211 and 212 is slightly narrow.

Figure 10:
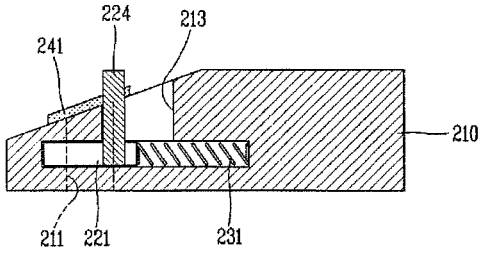
FIG. 10 is a sectional view taken along line in FIG. 8.

As shown in FIGS. 8 and 10, the guide unit 224 may protrude in a direction substantially perpendicular to the opening and closing direction of the first damper plate 220, and may have a length such that an end thereof is exposed from the sealing face 215 via the guide hole 213 of the first damper housing 210 (e.g., a length that it can be in contact with the edge of the protrusion 43 of the refrigerating chamber door 4). In this example, the guide unit 224 may protrude in the same direction as the opening and closing direction of the first damper plate 220. Further, the guide hole 213 may pass through the front surface of the first damper housing 210 so that the guide unit 224 contacts the vertical sealing face 44 extending to the protrusion 43 of the refrigerating chamber door 4.

The damper springs 230 include first and second damper springs 231 and 232 provided at the rear portion of the plate body parts 221 and 222, respectively. The first and second damper springs 231 and 232 may be compression coil springs having an elasticity coefficient allowing the first and second damper springs 231 and 232 to be compressed when the refrigerating chamber door 4 is closed and restored when the refrigerating chamber door 4 is open. One end of the damper springs 231 and 232 is fixed to a rear wall face of the first damper housing 210 and the other end of the damper springs 231 and 232 is fixed to a rear side face of the plate body parts 221 and 222.

Figure 11:
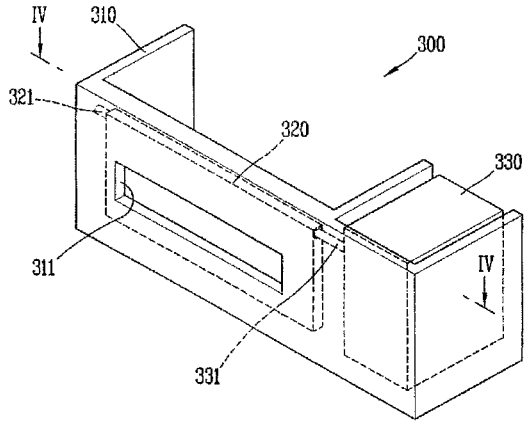
FIG. 11 is a perspective view of a second damper in the refrigerator of FIG. 1.
Figure 12:
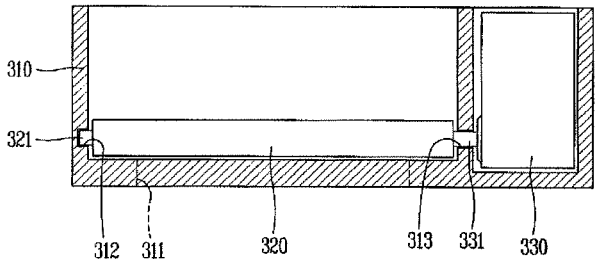
FIG. 12 is a sectional view taken along line IV-IV in FIG. 11.

FIGS. 11 and 12 illustrate a second damper 300. The second damper 300 includes a second damper housing 310, which is fixed to the ice making chamber. For instance, second damper housing 310 is fixed to an inner face of the ice making chamber cover 42. The second damper 300 also includes a second damper plate 320 rotatably installed at the second damper housing 310, and a damper motor 330 coupled to the second damper plate 320 and configured to selectively rotate the second damper plate 320.

The second damper housing 310 is open toward an inner wall face of the ice making chamber, has a box shape with a third cool air through hole 311, and is positioned on the side facing the ice making chamber cover 42. A hinge recess 312 and a hinge hole 313 are defined on wall faces of both sides of the second damper housing 310 such that a hinge protrusion 321 of the second damper plate 320 and a rotation shaft 331 of the damper motor 330 are rotatably positioned therewith.

The second damper plate 320 is flat, and a hinge protrusion 321 inserted into the hinge recess 312 and a fastening recess (not shown) to which the rotational shaft 331 of the damper motor 330 is attached are provided at upper ends of both sides of the second damper plate 320.

The damper motor 330 may be a step motor that can rotate the second damper plate 320 forward or backward about a certain angle. The rotational shaft 331 of the damper motor 330 is attached to a fastening recess of the second damper plate 320 through the hinge hole 313 of the second damper housing 320.

In some examples, if the second damper 300 is used based on whether ice making is completed in the ice making chamber 41, a full ice sensor is installed at the ice making chamber 41 to determine whether or not ice made in the ice making chamber 41 is full. In these examples, the damper motor 330 of the second damper 300 is operated according to output of the full ice sensor.

The blower 400 is installed separately to blow cool air of the freezing chamber 3 to the ice making chamber 41 and may also guide cool air of the freezing chamber 3 to the refrigerating chamber 2. The blower 400 may be installed in the freezing chamber 3 or at a middle portion between the first and second door ducts 120 and 130. When the blower 400 is installed at the cool air duct, it may be installed at the first door duct 120 to supply cool air. Although not shown, the blower 400 may be installed within the first damper housing 210 to form a module together with the first damper 200.

The refrigerating chamber door 4 has a door sealing face 43*a*. The door sealing face 43*a* seals the door 4 against a frame of the refrigerating chamber 2 to close an opening of the refrigerating chamber 2.

The refrigerator constructed as described above operates as follows. When ice making is required in a state that the refrigerating chamber door 4 is closed, the ice making device of the ice making chamber 41 is controlled to start an ice making operation. As the ice making operation starts, a water supply unit supplies water to the ice making container of the ice making device 7.

When supplying of water is completed, water in the ice making container is exposed to cool air supplied from the freezing chamber 3 to the ice making chamber 41 via the freezing chamber duct 110 and the first door duct 120 for more than a certain time period, so as to be frozen. For instance, when the refrigerating chamber door 4 is closed, the guide unit 224 of the first damper plate 220 of the first damper 200 is brought into contact with the edge of the protrusion 43 of the refrigerating chamber door 4, and the first damper plate 220 is pushed toward the rear wall face in the refrigerator along with the refrigerating chamber door 4. Then, the first damper plate 220, overcoming the elastic force of the damper springs 230, is pushed toward the rear wall face in the refrigerator, and the first and second cool air through holes 211 and 212 of the first damper housing 210 are simultaneously opened. Then, the blower 400 provided in the freezing chamber 3 operates to allow cool air in the freezing chamber 3 to be introduced into the inlet 121 of the freezing chamber duct 110. The cool air is introduced into the first door duct 120 via the first cool air through hole 211 of the first damper 200. Passing through the first door duct 120, the cool air is introduced from the outlet 122 toward one wall face of the ice making chamber 41 and then heat-exchanged with water of the ice making container to make ice.

Next, the cool air heat-exchanged with water in the ice making chamber 41 is returned to the freezing chamber 3 via the second door duct 130 according to an operation mode of the refrigerator or supplied to the refrigerating chamber 2 via the second damper 300 to cool the refrigerating chamber 2 and then returned to the freezing chamber 3 via the refrigerating chamber return duct 46.

Figure 13:
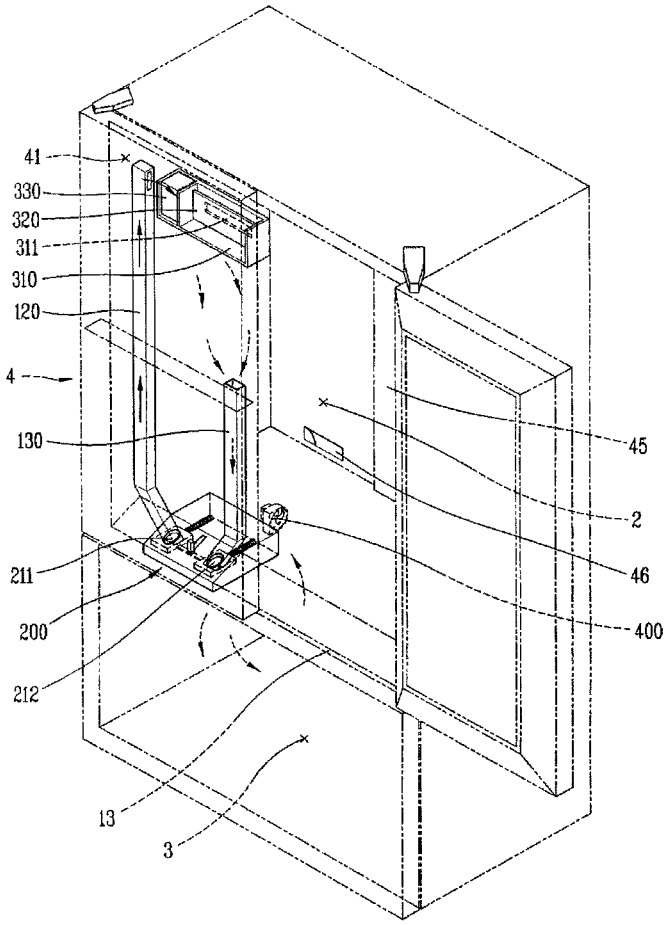
FIGS. 13 and 14 are a perspective view and a schematic vertical sectional view for explaining a circulation process of cool air in an ice making operation mode of the refrigerator of FIG. 1.
Figure 14:
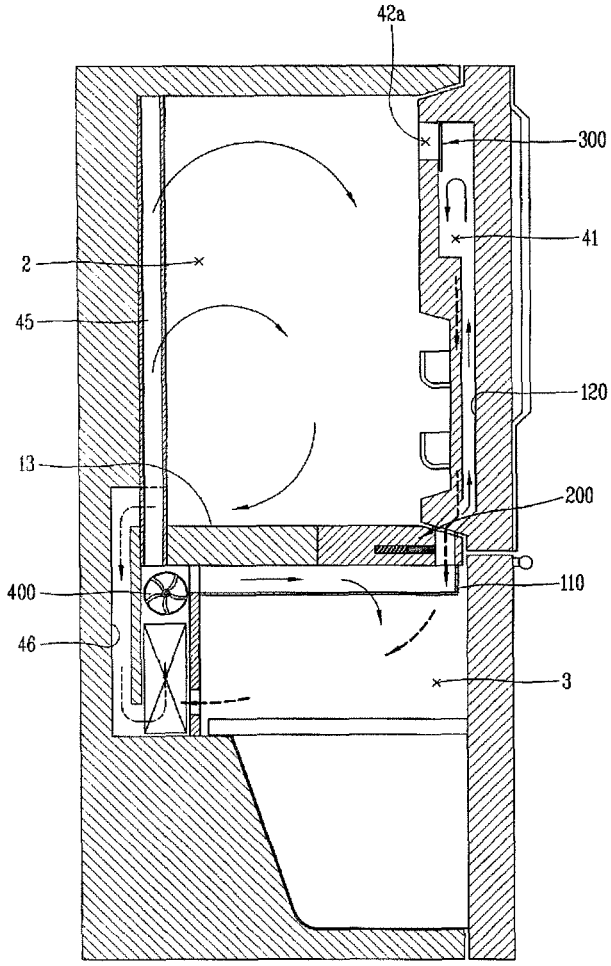

The process of returning cool air according to an operation mode of the refrigerator is described with reference to FIGS. 13 to 16. FIGS. 13 and 14 illustrate a circulation process of cool air in an ice making operation mode of the refrigerator, and FIGS. 15 and 16 illustrate a circulation process of cool air in a refrigerating operation mode of the refrigerator.

As shown in FIGS. 13 and 14, as the second damper 300 is closed, cool air supplied to the ice making chamber 41 flows through the ice making chamber 41 in a horizontal direction, is heat-exchanged with water in the ice making device, and then introduced to the inlet 131 of the second door duct 130 open at the lower end of the other side of the ice making chamber 41. The cool air flows down along the second door duct 130, is returned to the freezing chamber 3 via the second cool air through hole 212 of the first damper housing 210, and is then cooled again in the freezing chamber 3.

Figure 15:
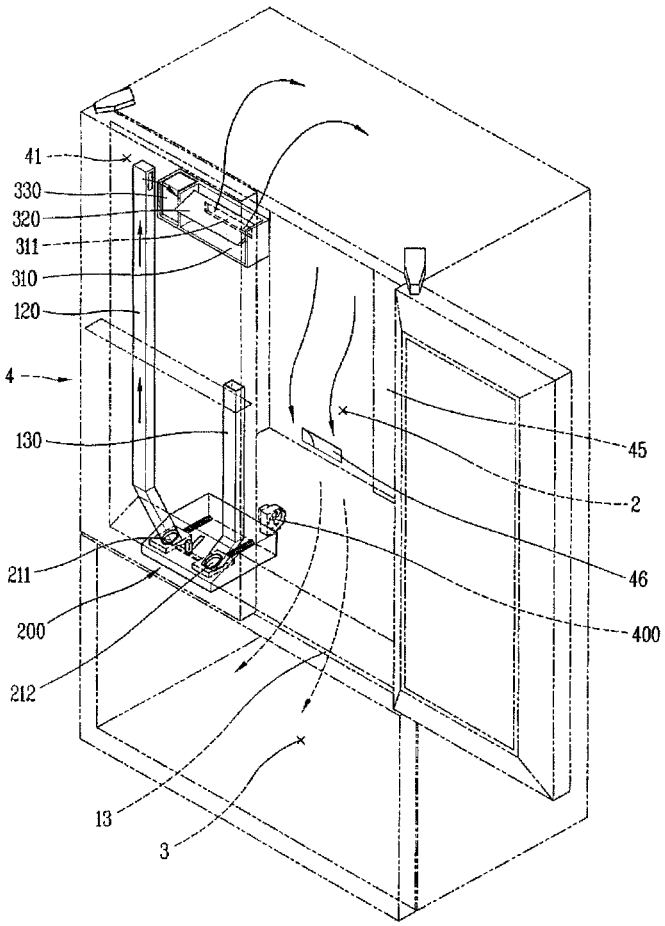
FIGS. 15 and 16 are a perspective view and a schematic vertical sectional view for explaining a circulation process of cool air in a refrigerating operation mode of the refrigerator of FIG. 1.
Figure 16:
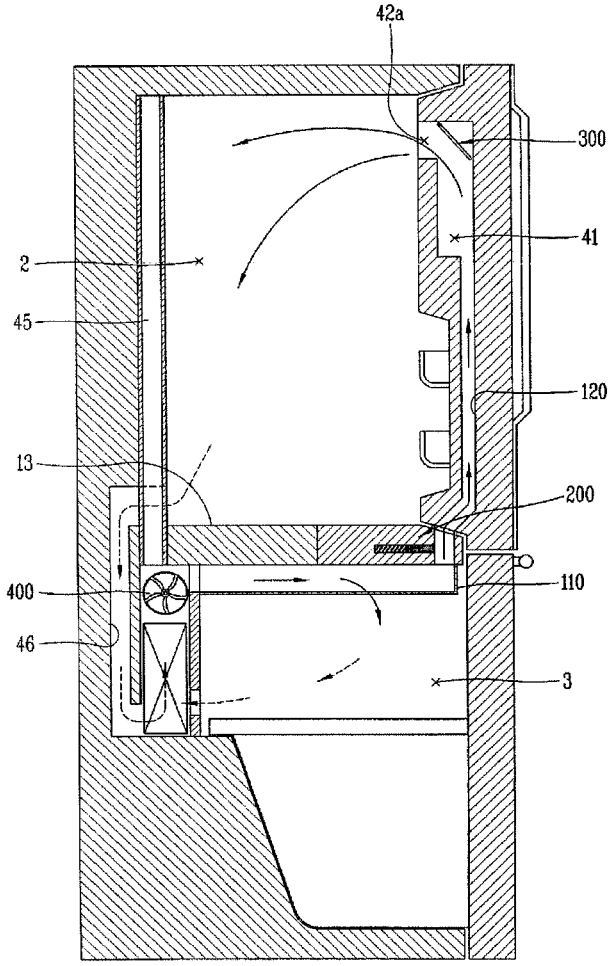

As shown in FIGS. 15 and 16, cool air supplied to the ice making chamber 41 as the second damper 300 is open is heat-exchanged with the ice making container as described above and flows to the inlet 131 of the refrigerating chamber 2 via the second damper 300 provided at one side of the ice making chamber 41. The cool air cools the refrigerating chamber 2 and then is returned to the freezing chamber 3 via the refrigerating chamber return duct 46.

In some implementations, timing of when the second damper is opened (e.g., changed to the refrigerating operation mode), may be determined according to control methods. For example, the second damper 300 may be controlled according to whether or not the ice making chamber is full of ice or according to a change in the temperature of the refrigerating chamber.

Figure 17:
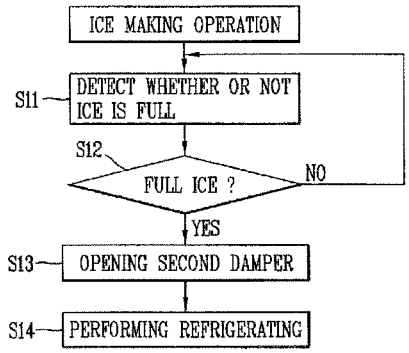
FIGS. 17 to 19 are flow charts illustrating example operation methods of the refrigerator of FIG. 1
Figure 18:
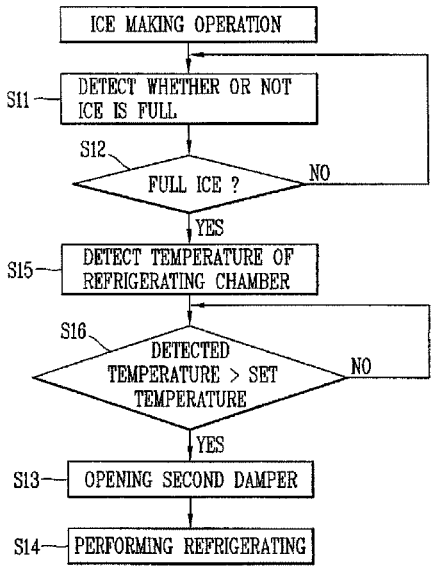
Figure 19:
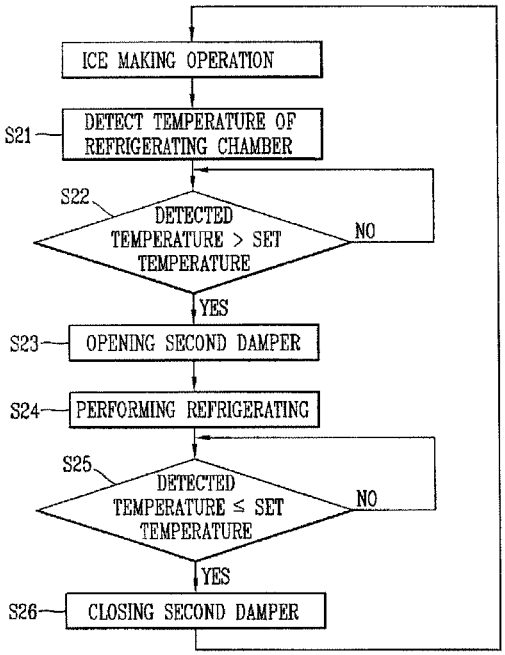

FIGS. 17 and 18 illustrate processes of controlling the second damper according to whether or not the ice making chamber is full of ice. FIG. 19 illustrates a process of controlling the second damper according to a change in the temperature of the refrigerating chamber.

First, as shown in FIG. 17, it is detected whether or not an ice making operation in the ice making chamber 41 has been completed through the full ice sensor provided at the ice making chamber 41 (S11). The detection may be made continuously in real time or periodically at pre-defined intervals. It is determined whether ice making has been completed based on the detected value (S12). In response to a determination that ice making has been completed based on the detected value, the damper motor 330 of the second damper 300 is controlled to rotate the damper plate 320 of the second damper 300 in an opening direction (S13). Then, the cool air discharge hole 42*a* is open, and cool air of the ice making chamber 41 is introduced into the refrigerating chamber 2 via the cool air discharge hole 42*a* to cool the refrigerating chamber 2 to a proper temperature (S14). In this case, cool air supplied via the ice making chamber 41 is supplied at a temperature required for ice making (e.g., at −14° C.). Because cool air is supplied at a temperature required for ice making, there is a possibility that the refrigerating chamber 2 is overcooled. Thus, a refrigerator microcomputer controls a refrigerating cycle to supply cool air at around a temperature (e.g., −3° C.) at which ice of the ice making chamber 41 would not be melt.

When the refrigerating chamber door 4 is closed, the first damper 200 is maintained in an open state, so cool air of the ice making chamber 41 may be introduced into the freezing chamber 3 via the second door duct 130. In this example, because the sectional area of the cool air discharge hole 42*a* of the ice making chamber is larger than that of the inlet 131 of the second door duct 130, the cool air discharge hole 42*a* of the ice making chamber 41 has a smaller flow path resistance as compared with the second door duct 130. Accordingly, cool air of the ice making chamber 41 is supplied to the refrigerating chamber 2 via the cool air discharge hole 42*a* of the ice making chamber 41. For instance, because of the difference in flow path resistance, more cool air passes through the cool air discharge hole 42*a* than the second door duct 130 when the second damper is open.

When the refrigerating chamber 2 is maintained at a temperature lower than a pre-set temperature level, the refrigerating chamber 2 may be overcooled by cool air introduced via the ice making chamber 41 or may be overcooled by cool air introduced from the freezing chamber 3 via the refrigerating chamber supply duct 45. Overcooling may cause an energy loss and inefficient or undesirable operation. Thus, as shown in FIG. 18, although the ice making operation in the ice making chamber 41 is determined to be completed based on the full ice sensor, the temperature of the refrigerating chamber 2 is detected by using a temperature sensor of the refrigerating chamber 2 (S15). It is determined whether the detected value is larger than a pre-set value (S16). If the detected value is larger than the pre-set value (S16), the second damper 300 is opened to supply cool air of the ice making chamber 41 to the refrigerating chamber 2 (S13 and S14). In this case, cool air supplied from the freezing chamber to the refrigerating chamber may be stopped. If the detected value is less than the pre-set value (S16), the temperature of the refrigerating chamber 2 is monitored to determine whether the temperature reaches the pre-set value.

As shown in FIG. 19, the temperature sensor is installed at the refrigerating chamber 2 to detect temperature of the refrigerating chamber 2 (e.g., in real time) (S21). It is checked whether or not the detected temperature of the refrigerating chamber 2 is higher than a pre-set temperature level (S22). According to the checking, the second damper 300 is opened to supply cool air of the ice making chamber 41 to the refrigerating chamber 2 (S23, S24) when the temperature is detected as being greater than the pre-set temperature level. In this case, because an excessive load has been generated in the refrigerating chamber 2, the ice making chamber 41 may stop its ice making operation, or in some examples, the ice making operation is performed slowly to temporarily supply cool air to the refrigerating chamber 2. Cool air supplied to the ice making chamber 41 may be maintained at a temperature (e.g. −14° C.) required for making ice. Of course, also in this case, when it is determined that an ice making operation in the ice making chamber 41 is completed through the full ice sensor, the refrigerating cycle may be controlled to supply cool air to the refrigerating chamber at a temperature of about −3° C.

The temperature of the refrigerating chamber 2 is continually detected, and if the detected temperature is lower than or the same as the pre-set temperature, the second damper 300 may be closed and the ice making operation may be resumed (S25, S26).

When the refrigerating chamber door 4 is open in the course of supplying cool air from the freezing chamber 3 to the ice making chamber 41, an external force pushing the first damper plate 220 of the first damper 200 is released, returning the first damper plate 220 to its original position by virtue of the restoration force of the damper springs 230. That is, the plate body parts 221 and 222 of the first damper plate 220 are moved to positions at which the cool air through holes 211 and 212 of the damper housing 210 are blocked. Accordingly, the freezing chamber duct 110 and the first door duct 120 or the second door duct 130 and the freezing chamber duct 110 are blocked, reducing leakage of cool air to the outside of the refrigerator by a natural convection. Also, the second damper plate 320 of the second damper 300 is returned to the closed position by the damper motor 330, thereby reducing leakage of cool air of the ice making chamber 41.

Accordingly, cool air from the freezing chamber is directly supplied to the refrigerating chamber door via the barrier, so a loss of cool air may be prevented in advance. In related art, because the cool air duct that transfers cool air of the freezing chamber to the ice making chamber is provided at the side wall face of the refrigerating chamber, an insulation thickness is reduced to generate a loss of cool air, or because the cool air duct is slanted, the movement distance of cool air is increased to generate a loss of cool air. However, in some implementations, because cool air is directly supplied to the refrigerating chamber door, the insulation thickness is increased to reduce a loss of cool air and because the cool air duct is a straight line, the movement distance of the cool air is reduced to thus reduce a loss of cool air.

In addition, as well as the increase in the insulation thickness with respect to the cool air duct, because the cool air duct is positioned within the refrigerating chamber, a temperature difference with external air is reduced. This effectively reduces or prevents generation of frost at the cool air duct. Accordingly, a defrosting heater may not need to be installed, or, if the defrosting heater is installed, its operation time can be reduced, thus reducing a loss of cool air passing through the cool air duct and power consumption in using the heater.

Moreover, because the cool air duct is positioned at the refrigerating chamber door, time for cool air to stay in the ice making chamber can be lengthened. This may enable quick and uniform cooling of water in the ice making container. In the related art, because the cool air duct is connected to one side of the ice making chamber, the inlet and outlet of the ice making chamber are close to one wall face, and thus, a portion of cool air introduced into the ice making chamber via the cool air duct is not circulated throughout the entire ice making chamber, but is quickly discharged from the ice making chamber. However, in the some implementations, because the first and second door ducts are disposed with a certain height difference at both sides of the ice making chamber with the ice making device interposed therebetween, the inlet and the outlet of the ice making chamber are relatively far away from each other. Accordingly, most cool air introduced into the ice making chamber via the first door duct flows to the second door duct after passing through the ice making device and cool air can stay in the ice making chamber for more time, each of which increases an amount of cool air in contact with the ice making device. As such, time for making ice in the ice making device may be shortened, ice may be made uniformly, a loss of cool air in the ice making chamber may be significantly reduced, and thus, energy efficiency of the refrigerator may be improved.

Furthermore, according to an operation mode of the refrigerator, the cool air supplied to the ice making chamber may not be returned toward the freezing chamber, but supplied to the refrigerating chamber via the cool air discharge hole of the ice making chamber. This may effectively use cool air. When the ice making chamber needs ice making, cool air is circulated between the ice making chamber and the freezing chamber to provide temperature required for ice making, and accordingly, an ice making operation can be performed in the ice making chamber. Meanwhile, when the ice making operation in the ice making chamber is completed, or when the load of the refrigerating chamber is rapidly increased, cool air supplied to the ice making chamber is supplied to the refrigerating chamber so as to cool the refrigerating chamber. Therefore, the utilization of cool air may be increased and the load change in the refrigerator may be quickly coped with, according to which power consumption may be reduced to enhance the energy efficiency.

The techniques described through the disclosure are not limited to a 3D-bottom freezer type refrigerator in which the freezing chamber is installed at the lower portion of the refrigerator, the refrigerating chamber is installed at the upper portion of the refrigerator, and the ice making chamber is installed at the refrigerating chamber door. Rather, the techniques may be applicable to other types of refrigerators, such as a refrigerator in which an ice making chamber is provided at the refrigerating chamber door and cool air of the freezing chamber is supplied to the ice making chamber.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a refrigerator body;

a refrigerating compartment defined at a first portion of the refrigerator body;

a freezing compartment defined at a second portion of the refrigerator body, the second portion of the refrigerator body being different than the first portion of the refrigerator body and the freezing compartment being separated from the refrigerating compartment by one or more walls;

at least one evaporator configured to cool air used in regulating operating temperatures in the refrigerating compartment and the freezing compartment that differ, with the freezing compartment having an operating temperature that is lower than an operating temperature of the refrigerating compartment;

a refrigerating compartment door that is configured to open and close at least a portion of the refrigerating compartment;

a freezing compartment door that is configured to open and close at least a portion of the freezing compartment;

an ice compartment positioned at the refrigerating compartment door and configured to receive cool air from the freezing compartment;

one or more ducts defining a first flow path configured to circulate cool air between the freezing compartment and the ice compartment;

one or more ducts defining a second flow path configured to circulate cool air between the freezing compartment, the ice compartment, and the refrigerating compartment;

an ice level sensor configured to detect a level of ice within the ice compartment; and a unit positioned at the second flow path and configured to control air flow along at least a portion of the second flow path based on the level of ice within the ice compartment.

2. The refrigerator of claim 1, further comprising:

an ice maker positioned within the ice compartment and configured to freeze liquid water into ice, wherein the ice level sensor comprises a full ice sensor configured to detect whether or not ice making has been completed by the ice maker, and the unit is configured to control air flow along at least a portion of the second flow path based on the detection of whether or not the ice making in the ice compartment has been completed.

3. The refrigerator of claim 1, further comprising a temperature sensor configured to detect temperature of the refrigerating compartment, wherein the unit is configured to control air flow along at least a portion of the second flow path based on the temperature of the refrigerating compartment detected by the temperature sensor.

4. The refrigerator of claim 1, wherein the one or more ducts defining the first flow path include:

a supply duct positioned on an interior surface of the refrigerating compartment door at a first side of the refrigerating compartment door, the supply duct defining a supply flow path, and a return duct positioned on the interior surface of the refrigerating compartment door at a second side of the refrigerating compartment door that is opposite of the first side, the return duct defining a return flow path, and a second unit positioned at a barrier that separates the freezing compartment and the refrigerating compartment, that defines, through the barrier, a supply passage configured to interface with the supply duct when the refrigerating compartment door is oriented in a closed position and separate from the supply duct when the refrigerating compartment door is oriented in an opened position, that defines, through the barrier, a return passage configured to interface with the return duct when the refrigerating compartment door is oriented in the closed position and separate from the return duct when the refrigerating compartment door is oriented in the opened position, and that includes at least one blocking unit that is configured to open the supply passage and the return passage when the refrigerating compartment door is oriented in the closed position and close the supply passage and the return passage when the refrigerating compartment door is oriented in the opened position.

5. A refrigerator comprising:

a refrigerator body;

a refrigerating compartment defined at a first portion of the refrigerator body;

a freezing compartment defined at a second portion of the refrigerator body, the second portion of the refrigerator body being different than the first portion of the refrigerator body and the freezing compartment being separated from the refrigerating compartment by a barrier;

at least one evaporator configured to cool air used in regulating operating temperatures in the refrigerating compartment and the freezing compartment that differ, with the freezing compartment having an operating temperature that is lower than an operating temperature of the refrigerating compartment;

a refrigerating compartment door that is configured to open and close at least a portion of the refrigerating compartment;

a freezing compartment door that is configured to open and close at least a portion of the freezing compartment;

an ice compartment positioned at the refrigerating compartment door and configured to receive cool air from the freezing compartment;

one or more door ducts positioned at the refrigerating compartment door and configured to guide cool air from the freezing compartment to the ice compartment;

a refrigerating compartment supply duct configured to guide cool air from the freezing compartment to the refrigerating compartment;

a refrigerating compartment return duct configured to guide cool air of the refrigerating compartment to the freezing compartment;

a first unit that is positioned at the barrier that separates the freezing compartment and the refrigerating compartment, that is configured to connect, through one or more passages in the barrier, the one or more door ducts to the freezing compartment when the refrigerating compartment door is oriented in a closed position, and that is configured to close the one or more passages in the barrier when the refrigerating compartment door is oriented in an opened position; and a second unit positioned at the ice compartment and configured to open and close a passage defined in a wall that separates the ice compartment from the refrigerating compartment.

6. The refrigerator of claim 5, wherein the first unit comprises a housing having one or more cool air through holes that allow the one or more door ducts and the freezing compartment to communicate when the refrigerating compartment door is oriented in the closed position, and a plate configured to open and close the one or more cool air through holes of the housing in response to closing and opening of the refrigerating compartment door.

7. The refrigerator of claim 6, further comprising an elastic member positioned at one side of the plate, and, when the refrigerating compartment door is oriented in the opened position, the elastic member applies force to the plate in a direction that causes the plate to close the one or more cool air through holes.

8. The refrigerator of claim 6, further comprising a guide hole defined by the housing, and a guide unit that is coupled to the plate, that has at least a portion inserted into the guide hole, that is configured to be pressed by the refrigerating compartment door when the refrigerating compartment door moves from the opened position to the closed position, and that is configured to, in response to being pressed by the refrigerating compartment door, move the plate from a first position in which the plate closes the one or more cool air through holes to a second position in which the plate opens the one or more cool air through holes.

9. The refrigerator of claim 6, further comprising a sealing member provided to at least one of the one or more door ducts and the one or more cool air through holes.

10. The refrigerator of claim 6, wherein a portion of the housing where an end of the one or more door ducts interfaces with the one or more cool air through holes is inclined relative to ground when the refrigerator body is oriented in an ordinary operating orientation.

11. The refrigerator of claim 6, a portion of the housing where an end of the one or more door ducts interface with the one or more cool air through holes is perpendicular to ground when the refrigerator body is oriented in an ordinary operating orientation.

12. The refrigerator of claim 5, further comprising an ice maker positioned within the ice compartment and configured to freeze liquid water into ice, wherein the second unit is configured to open and close the passage defined in the wall that separates the ice compartment from the refrigerating compartment based on whether or not ice making by the ice maker has been completed and a temperature of the refrigerating compartment.

13. The refrigerator of claim 12, further comprising a full ice sensor configured to detect completion of ice making by the ice maker, wherein the second unit is configured to open the passage in response to detection, by the full ice sensor, of completion of ice making by the ice maker.

14. The refrigerator of claim 12, further comprising a temperature sensor positioned in the refrigerating compartment, wherein the second unit is configured to open the passage in response to detection, by the temperature sensor, of a temperature in the refrigerating compartment that is higher than a pre-set temperature level.

15. The refrigerator of claim 5, wherein a cross-sectional area of an outlet of the second unit is larger than a cross-sectional area of an outlet of the one or more door ducts.

16. The refrigerator of claim 5, wherein the one or more door ducts comprise a first door duct configured to guide cool air of the freezing compartment to the ice compartment, and a second door duct separated from a flow path of the first door duct and configured to guide cool air of the ice making compartment to the freezing compartment.

17. The refrigerator of claim 5, further comprising an ice maker positioned within the ice compartment and configured to freeze liquid water into ice, wherein an outlet of the first door duct and an inlet of the second door duct are positioned on opposite sides of the ice maker such that air flow from the outlet of the first door duct to the inlet of the second door duct passes over the ice maker.

18. The refrigerator of claim 5, wherein the one or more door ducts are positioned such that at least a portion of the one or more door ducts is within a range of the refrigerator body when the refrigerating compartment door is oriented in the closed position.

19. The refrigerator of claim 5, wherein the refrigerating compartment door comprises a protrusion on its inner surface such that the protrusion is positioned in the refrigerator body when the refrigerating compartment door is oriented in the closed position, and the one or more door ducts are positioned on an inner face of the protrusion or at an inner side of the protrusion.

20. The refrigerator of claim 5, wherein the barrier comprises a freezing compartment duct with a first end of the freezing compartment duct communicating with the freezing compartment and a second end of the freezing compartment duct communicating with at least one of the one or more door ducts when the refrigerating compartment door is oriented in the closed position.

21. The refrigerator of claim 5, wherein a blow fan is positioned within at least one of the freezing compartment, the one or more door ducts, and the first unit and is configured to promote movement of cool air of the freezing compartment to the ice making compartment.

22. The refrigerator of claim 5, wherein at least one evaporator is configured to generate cool air and is positioned on at least one of a wall face of the freezing compartment, a wall face of the refrigerating compartment, and within the barrier.

23. A method for controlling air flow in a refrigerator having a refrigerating compartment and a freezing compartment, the method comprising:

detecting, using an ice level sensor, a level of ice within an ice compartment that is positioned on a refrigerating compartment door configured to open and close at least a portion of the refrigerating compartment and that is configured to receive cool air from the freezing compartment; and controlling, using a unit positioned at a flow path that is defined by one or more ducts and that is configured to circulate cool air between the freezing compartment, the ice compartment, and the refrigerating compartment, air flow along at least a portion of the flow path based on the detected level of ice within the ice compartment.

24. The method of claim 23, wherein:

detecting the level of ice within the ice compartment comprises detecting whether or not ice making in the ice compartment has been completed; and controlling air flow along at least a portion of the flow path based on the detected level of ice within the ice compartment comprises controlling air flow along at least a portion of the flow path based on the detection of whether or not ice making in the ice compartment has been completed.

25. The method of claim 24, further comprising detecting, using a temperature sensor, a temperature of the refrigerating compartment, wherein controlling air flow along at least a portion of the flow path comprises controlling air flow along at least a portion of the flow path based on the detected temperature of the refrigerating compartment, including blocking air flow along at least the portion of the flow path when the detection of whether or not ice making in the ice compartment has been completed reveals that ice making in the ice compartment has been completed and when the detected temperature of the refrigerating compartment is less than a threshold temperature.

26. The method of claim 23, further comprising detecting, using a temperature sensor, a temperature of the refrigerating compartment, wherein controlling air flow along at least a portion of the flow path comprises controlling air flow along at least a portion of the flow path based on the detected temperature of the refrigerating compartment, including allowing air flow along at least the portion of the flow path when the detected temperature of the refrigerating compartment is greater than a threshold temperature.

* * * * *